United States Patent [19]

Della Torre

[11] 3,957,002

[45] May 18, 1976

[54] BED COVER FOR A SEWING MACHINE

[75] Inventor: Giancarlo Della Torre, Milan, Italy

[73] Assignee: The Singer Company, New York, N.Y.

[22] Filed: Sept. 29, 1975

[21] Appl. No.: 617,769

[30] Foreign Application Priority Data

Apr. 30, 1975 Italy ..... 22915/75

[52] U.S. Cl. ..... 112/258

[51] Int. Cl.[2] ..... D05B 75/00

[58] Field of Search ..... 112/258, 260, 217.1; 312/208; 248/19, 22, 20

[56] References Cited

UNITED STATES PATENTS

| | | | |
|---|---|---|---|
| 1,304,750 | 5/1919 | Dosch et al. | 112/258 |
| 1,978,281 | 10/1934 | Pfaff | 112/258 |
| 2,179,392 | 11/1939 | Weis et al. | 112/260 |
| 2,325,928 | 8/1943 | Zeier | 112/258 |
| 3,162,406 | 12/1964 | Stanton et al. | 312/20 |

*Primary Examiner*—George H. Krizmanich
*Attorney, Agent, or Firm*—Robert E. Smith; Edward L. Bell; Edward P. Schmidt

[57] ABSTRACT

A prepainted sheet metal bed cover attachable to a top portion of a sewing machine bed casting having a minimum of machining on an upper surface thereof. The bed cover rests on a machined raised peripheral rim on the upper surface, and is additionally supported on resilient non-metallic material deposited on pads interspersed on the upper surface which are machined to a level below the raised peripheral rim to accommodate the non-metallic material between the bed cover and the pads. The cover is firmly fixed to the top portion of the bed casting by a skirt portion of the prepainted bed cover which extends about the periphery of the top portion, and is swedged beneath the top portion of the bed casting to form a unitary assembly therewith.

4 Claims, 5 Drawing Figures

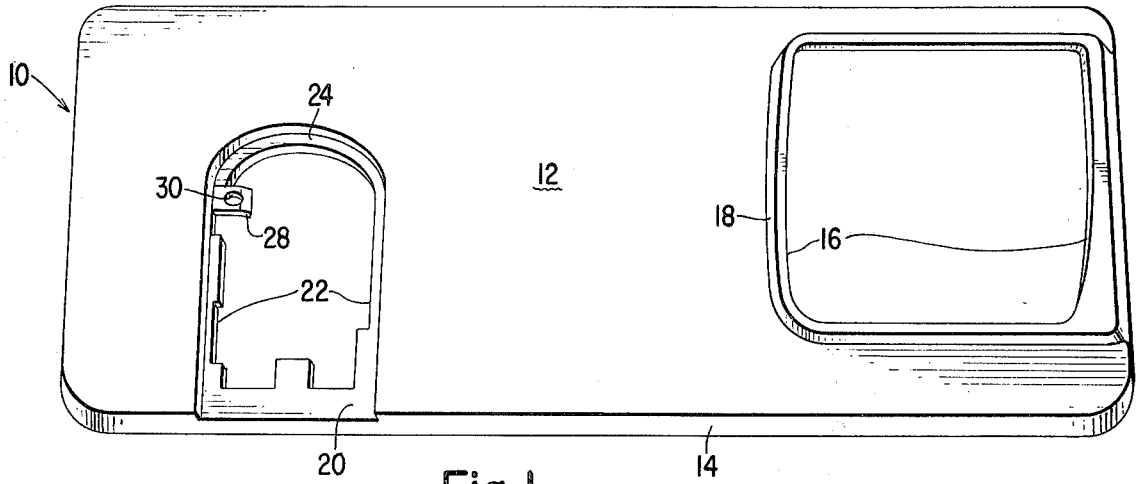
Fig.1
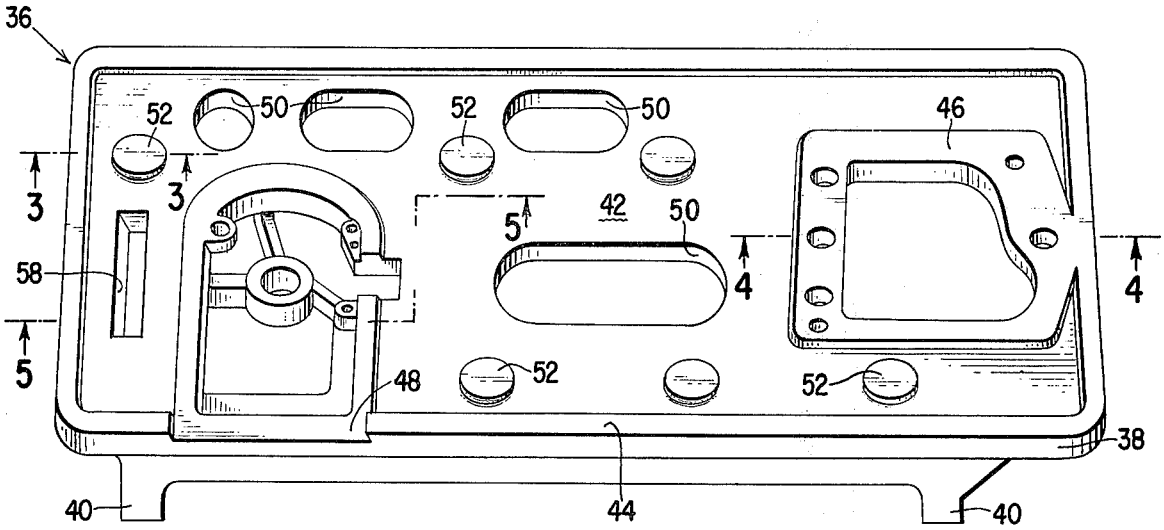
Fig.2
Fig.3
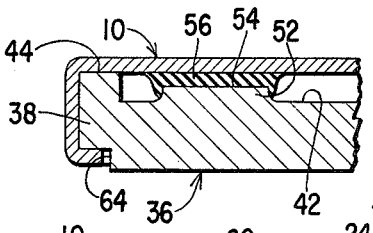
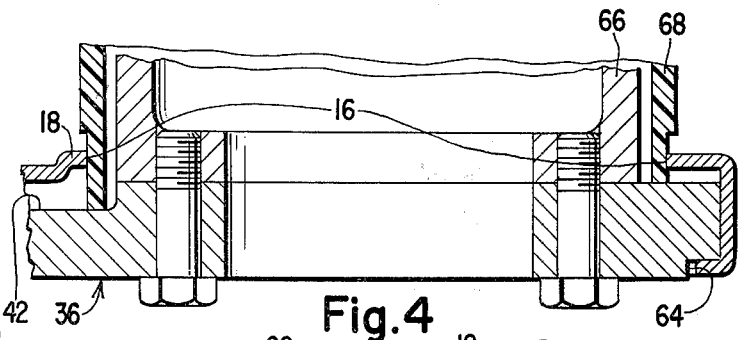
Fig.4
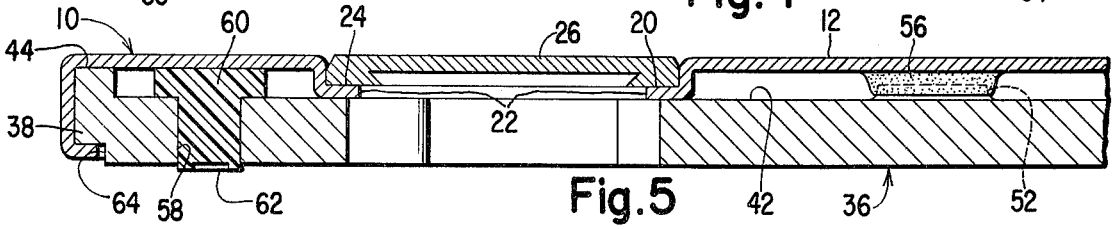
Fig.5

BED COVER FOR A SEWING MACHINE

BACKGROUND OF THE INVENTION There are prior art sewing machines in which bed cover plates are directly attached to a sewing machine bed casting by screws, or are attached by other means providing noise and vibration isolation. In general the constructions disclosed were adopted in order to obtain the advantages of vibration isolation, as disclosed in the U.S. Pat. No. 2,694,375; or to reduce noise, as disclosed in the U.S. Pat. No. 1,998,880; or to obtain light-weight construction, as disclosed in the U.S. Pat. No. 2,341,975.

Prior art sewing machines have also made use of plastic bed cover plates as well as plastic cover plates for the arm and standard of the sewing machine.

However, the use of plastic bed cover plates is not particularly desirable in that, due to the nature of the use to which sewing machine beds are put, there is great potential for scratching or otherwise marring of a plastic bed cover plate.

What is required is a bed cover plate which obtains the above noted advantages while retaining a relatively firm working surface and without incurring the susceptibility to scratching or marring found with plastic cover plates. It is further desirable that these advantages may be obtained in an economical form of construction.

SUMMARY OF THE INVENTION

A preformed and prepainted sheet metal bed cover is fabricated for attachment to a top portion of a bed casting. The bed is cast with a raised peripheral rim and a sewing machine arm standard supporting boss projecting from the upper surface of the top portion thereof. Additional support pads are interspersed on the upper surface internal of the raised peripheral rim. The peripheral rim and standard supporting boss may be machined to one level and the support pads are machined to a second level somewhat below the peripheral rim. Resilient nonmetallic material is applied to the support pads so that when the bed cover plate is placed on the machined bed casting it is supported on the raised peripheral rim of the bed and obtains additional support from the resilient non-metallic material on the support pads. The bed cover plate is fabricated with a skirt which extends below the top portion of the bed casting. The skirt is deformed beneath the top portion of the casting thereby to become firmly attached thereto. The resilient non-metallic material between the sheet metal bed cover and the support pads maintain resilient connection between the two components and aids in forming a unitary assembly with a relatively firm working surface, and providing a substantial degree of vibration isolation and, therefore, noise attenuation.

DESCRIPTION OF THE DRAWINGS

The invention is depicted in the appended drawings in which:

FIG. 1 is a plan view of the sheet metal bed cover, slightly tilted to show details of construction;

FIG. 2 is a perspective view of the machined cast bed, slightly tilted to indicate details of construction;

FIG. 3 is a section taken substantially along line 3—3 of FIG. 2 showing the bed cover assembled to the cast bed with the resilient non-metallic material trapped between a support pad and the prepainted sheet metal bed cover;

FIG. 4 is a section taken substantially along line 4—4 of FIG. 2 showing the bed cover assembled to the cast bed, a portion of the sewing machine arm standard bolted to the cast bed, and portion of the plastic cover for the arm standard engaged with the bed cover; and, FIG. 5 is a section taken substantially along line 5—5 of FIG. 2 showing the bed cover assembled to the cast bed, a plastic insert for the machine serial number, and a bed slide plate arranged in a depression of the bed cover provided for that purpose.

In FIG. 1 is shown a sheet metal bed cover 10, preferably made of sheet steel, having a large flat work supporting surface 12. The bed cover 10 is fabricated with a skirt 14, the purpose of which will become apparent shortly. The right side of the bed cover 10 contains a large cavity 16 in a raised platform 18 through which the arm standard and arm cover plates of a sewing machine may project. The left side of the cover plate 10 has a depressed area 20 which contains a large cavity 22 providing access to sewing hook and bobbin case carried in the bed of the sewing machine. The cavity 22 is spaced in the depressed area 20 that a rim 24 remains to support a throat plate (not shown) and bed slide plate 26 (see FIG. 5). An ear 28 having a bore 30 projects into cavity 22 to provide support and a degree of resilient loading to the throat plate clamping means (not shown).

The bed cover 10 is ideally prepainted after forming and before assembly thereby obviating the need to paint the assembled cover and machined bed. The painted surface may be protected with a strippable plastic film to protect the painted surface during assembly of the bed cover 10 to the machined bed casting and during assembly of the sewing machine components, after which the plastic film may be removed.

In FIG. 2 is shown a machined bed casting 36. The bed casting 36 has a top portion 38 which is supported by mounting legs, 40, two of which are visible in FIG. 2. The upper surface 42 of the top portion 38 is cast with a raised peripheral rim 44 and an arm standard supporting boss 46. As indicated in FIGS. 2 and 4, the rim 44 and the boss 46 may be machined to the same level. On the left side of the bed casting 36 a depression 48 is cut throught the rim 44 to receive and support the depressed area 20 of the bed cover 10. Wherever possible lightening holes 50 extend through the top portion 38 to aid in obtaining a light weight casting.

A rectangular cavity 58 on the left side of the bed casting 36 is designed to receive a plastic insert 60 on which the serial number 62 of the sewing machine may be impressed (See FIG. 5). The plastic insert 60 is T-shaped to be trapped in the cavity 58 when the top cover 10 is assembled on the bed casting 36.

Also projecting upwardly from the upper surface 42 of the top portion 38 are support pads 52, interspersed over the upper surface for the purpose of providing additional support to the bed cover 10 as will be explained below. The top surface 54 of the support pads 52 are machined to a level below that of the rim 44 (See FIG. 3).

Prior to assembly of the top cover 10 to the machined bed casting 36 a resilient non-metallic cushion material 56, preferably polyurethane material, is placed on top of each support pad 52 in abundant quantity to make up for the aforementioned difference in level between the top surface 54 of the support pad 52 and the raised peripheral rim 44. Thus as the top cover 10 is assembled to the machined bed casting 36, the top cover will rest on the rim 44, and the cushion material 56 on the support pads 52 will provide a resilient connection between the support pads and the top cover internally of the peripheral rim 44. It is preferable to have as a cushion material substance which will adhere to the bed cover 10 and the support pads 52 after a suitable cure period to permit assembly of the cover to the bed casting 36.

Referring to FIGS. 3, 4 and 5 it will be noted that the under side of the top portion 38 has a peripheral rabbet 64 machined into it, into which the skirt 14 of the top cover 10 is swedged to form a unitary assembly of the top cover and the machined bed casting 36. FIG. 4 also indicates the assembly of the sewing machine arm standard 66 to the bed casting 36, and the assembly of plastic arm standard cover 68 about the arm standard abutting the cavity 16 in the raised platform 18 of the topcover.

Having thus set forth the nature of the invention what is claimed is:

1. In a sewing machine, a bed comprising: a bed casting including a top portion having an upper surface, a raised peripheral rim on said upper surface, a plurality of pads interspersed on said upper surface below the level of said raised peripheral rim; resilient non-metallic cushions on said plurality of pads; a sheet metal bed casting top cover supported on said bed casting raised peripheral rim and on said resilient non-metallic cushions on said plurality of pads; and, means permanently affixing said sheet metal top cover to said bed casting.

2. In a sewing machine as claimed in claim 1 wherein said sheet metal cover includes a skirt portion extending from said raised peripheral rim to a position beneath the top portion of said bed casting, and in which the deformation of said skirt portion to a position beneath the top portion of said bed casting provides said means affixing said sheet metal cover to said bed casting.

3. In a sewing machine as claimed in claim 1 wherein said resilient non-metallic cushions are adherent to said pads and to said sheet metal bed casting cover.

4. In a sewing machine as claimed in claim 1 wherein said sheet metal bed casting cover has a prepainted surface obviating the necessity for painting said bed after assembly of said bed casting cover to said bed casting.

* * * * *